US005480318A

United States Patent [19]

Garrison

[11] Patent Number: 5,480,318

[45] Date of Patent: Jan. 2, 1996

[54] CHILDPROOF ELECTRICAL PLUG

[76] Inventor: Dale E. Garrison, P.O. Box 157, Richland, Ind. 47634

[21] Appl. No.: 315,435

[22] Filed: Sep. 30, 1994

[51] Int. Cl.[6] ..... H01R 13/639

[52] U.S. Cl. ..... 439/346; 439/102

[58] Field of Search ..... 439/102–104, 439/106, 176, 131, 166–167, 324, 345–346, 265, 270

[56] References Cited

U.S. PATENT DOCUMENTS

| | | | |
|---|---|---|---|
| 2,757,350 | 7/1956 | Watts | 439/346 |
| 3,693,136 | 9/1972 | Appleton | 439/346 |
| 3,890,025 | 6/1975 | Gray | 339/14 P |
| 4,111,509 | 9/1978 | Novak | 439/102 |
| 5,082,450 | 1/1992 | Warren, Sr. et al. | 439/102 |
| 5,194,013 | 3/1993 | Propp | 439/265 |
| 5,249,976 | 10/1993 | Brock | 439/102 |

*Primary Examiner*—Gary F. Paumen
*Assistant Examiner*—Hien D. Vu
*Attorney, Agent, or Firm*—Henry S. Miller; Rhodes & Ascolillo

[57] ABSTRACT

A common, grounded three-conductor male electrical plug including in the grounded blade a spring biased catch for engaging the walls of a female receptacle and locking the plug in the receptacle. An aperture in the plug allows a non-conductive tool to move the catch against the spring bias and away from the walls of the receptacle to unlock the plug and permit removal from the receptacle.

4 Claims, 2 Drawing Sheets

CHILDPROOF ELECTRICAL PLUG

BACKGROUND OF THE INVENTION

1. Field of the Invention

This invention relates to electrical safety equipment and more particularly to a childproof electrical plug.

2. Description of the Prior Art

The enhanced quality of life enjoyed today has been brought about to a great extent by the revolution in the electrical and electronics field. The vast majority of the products that have raised our standard of living are consumer items that are used in and around the home. This being the case, most of these items operate from electrical current distributed around the house via a very conventional and known system utilizing hard wire, fuses and electrical outlets. The electrical outlets, as a general rule, are located in a wall approximately eighteen inches above the floor. This is a convenient location for children and provides easy access to the mischievous child or the simply curious child to place pins or the like into the outlet or on the other hand to remove leads already plugged into the outlet. Either situation constitutes a potentially hazard condition which needs the attention of both parents and the industry.

The above condition has not been ignored and a number of U.S. Patents have issued which attempt to provide a solution to the electrical outlet versus child conflict which continues to over shadow the convenience of modern gadgetry.

The U.S. Patents which are considered relevant and of which Applicant is aware include, U.S. Pat. No. 3,890,025 issued Jun. 17, 1975 to Gray for an electrical plug lock which utilizes a rotating cam within the ground connector to lock the plug within the female receptacle in the wall outlet. The U.S. Pat. No. 4,111,509 issued Sep. 5, 1978 to Novak is another electrical plug lock where the ground connector is expanded by a centrally positioned member that is attached to a threaded knob and retracts the end of the prong by turning the knob. U.S. Pat. No. 5,082,450 issued Jan. 21, 1992 to Warren, Sr. et al discloses a safety plug with plug prongs that move between an extended and a retracted state. In addition the ground prong contains a spring that extends without the prong and in some manner engages the receptacle locking the plug in place. In 1993 Propp was issued a U.S. Pat. No. 5,194,013 dated Mar. 16, 1993 for a plug lock that utilizes an internally threaded ground plug and a similarly threaded shaft with a cone shaped end that is drawn into the ground prong and causes it to expand against the sides of the female receptacle. U.S. Pat. No. 5,249,976 to Brock issued Oct. 5, 1993 for an electrical plug locking means is designed and adapted to be used with a heavier duty plug that includes a U-shaped ground blade and adds a member with a serrated edge rotated to engage the female receptacle.

The prior art fails to anticipate the childproof electrical plug of this invention, a substantial improvement in the state of the art.

SUMMARY OF THE INVENTION

The invention is directed to an electrical plug which may be connected to an electrical unit by a conventional cord or it may be a blank and simply server to block access to an electrical receptacle.

In a three conductor male electrical plug, where two of the prongs are of the blade type and the third a ground prong having a cylindrical shape and capped at one end, the improvement comprises a pair of opposed slots at mid-shaft of the ground prong and a spring biased V-shaped catch formed of spring steel and extending through the opposed slots and facing the plug body. The arms of the catch collapse into the prong, against the bias of the spring, as the plug is inserted into a receptacle. The bias of the spring causes the catch to engage the sidewalls of the receptacle and resist movement in what amounts to a withdrawal of the plug from the inserted position. A throughgoing aperture in the plug, aligned with mid-section of the catch, allows a non-conductive member to be inserted and depress the catch against the spring bias and causing the arms of the catch to be withdrawn into the body of the blade permitting the plug to be removed from the receptacle.

It is therefore an object of the invention to provide a new and improved childproof electrical plug.

It is another object of the invention to provide a new and improved electrical plug that requires positive action to be removed from a receptacle.

It is a further object of the invention to provide a new and improved electrical plug that is low in cost and simple to use.

It is still another object of the invention to provide a new and improved locking electrical plug that has all of the advantages of prior art locking plugs and none of the disadvantages.

It is still a further object of the invention to provide a new and improved locking electrical plug which may be easily and efficiently manufactured and marketed.

It is another object of the invention to provide a new and improved childproof electrical plug which is of a durable and reliable construction.

These together with other objects of the invention, along with the various features of novelty which characterize the invention, are pointed out with particularity in the claims annexed to and forming a part of this disclosure. For a better under standing of the invention, its operating advantages and the specific objects attained by its uses, reference should by has to the accompanying drawings and descriptive matter in which there is illustrated preferred embodiments of the invention.

DETAILED DESCRIPTION OF THE PREFERRED EMBODIMENT

Figure 1:
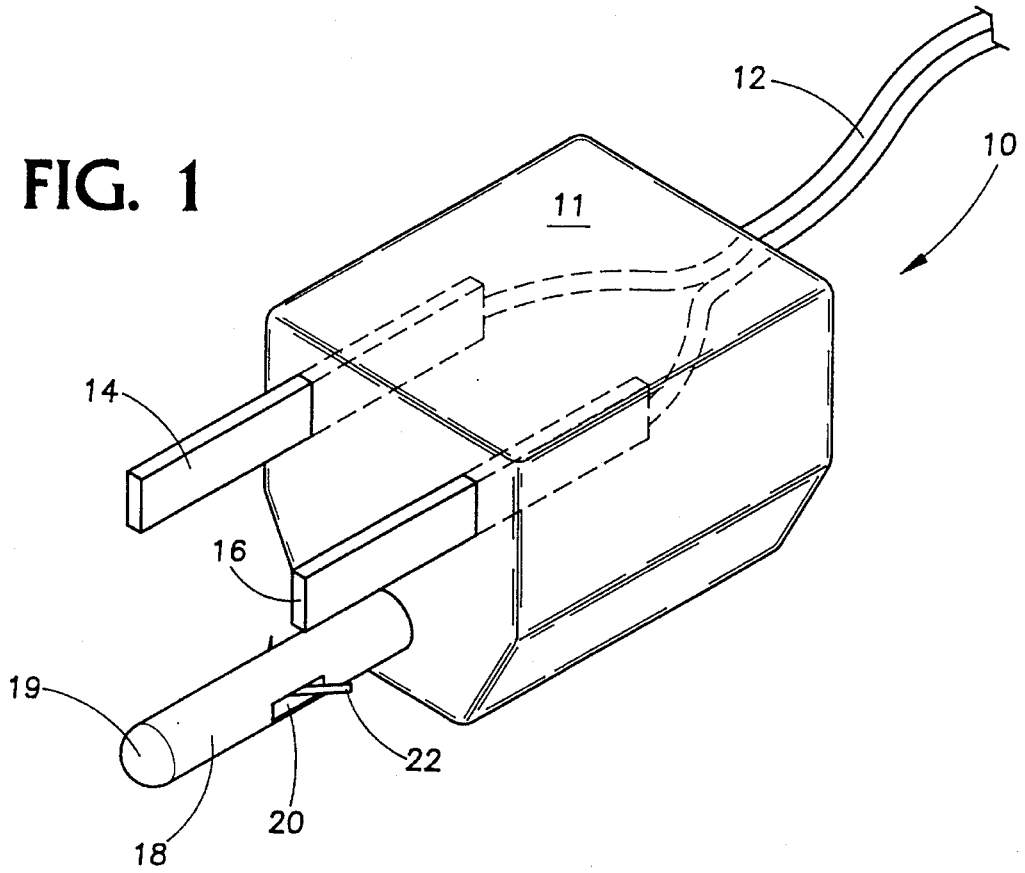
FIG. 1 is a perspective view of the invention.

Referring now to FIG. 1, the invention is shown generally at 10 and is formed of a body of insulative material 11 with an electrical connector in the form of a two conductor wire 12 that attached to an appliance of some description. Electrical prongs 14 and 16 are connected to wire 12 within the plug in a conventional manner. Ground prong 18 is hollow and capped at 19. Opposed slots 20 located mid-shaft on the prong allow the arms 22 of the V-shaped catch to extend beyond the limits of the prong body.

Figure 2:
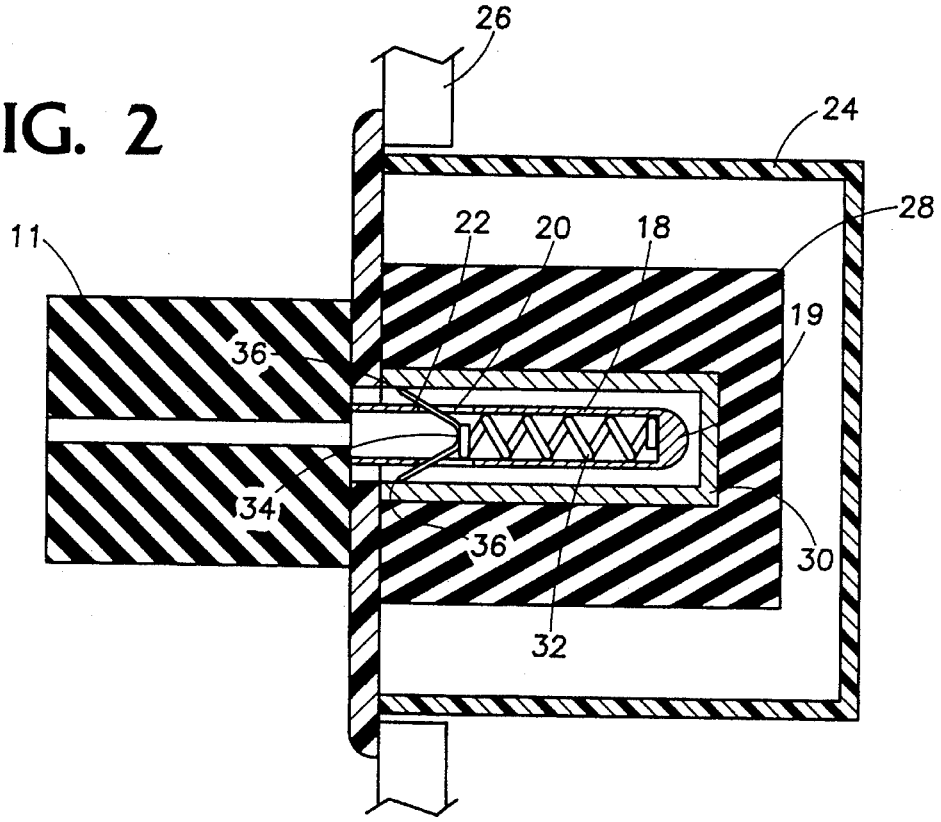
FIG. 2 is an environmental view of the invention in cross section.

Concerning FIG. 2 a standard electrical box 24 is mounted in a wall 26. The appropriate section of the receptacle is shown at 28. The ground prong receiving member of the receptacle 30 is shown engaging prong 18. Within the prong and abutting the cap 19 is a spring 32 which engages the angular section 34 of the catch which is formed of spring steel and has a natural bias to return to a linear configuration. The ends 36 of the catch are drawn to a point and engage the softer copper alloy of the receiving member 30. Any attempt to remover the prong from the receptacle will cause the catch to become more securely engaged in the receptacle material.

Figure 3A:
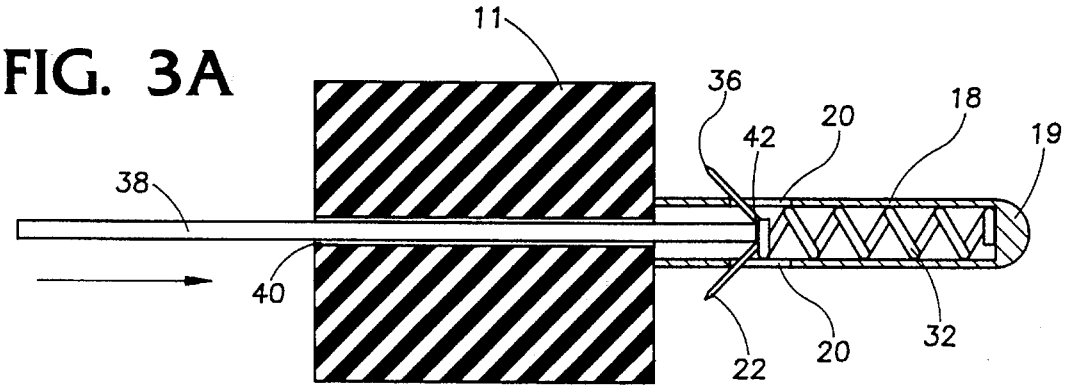
FIG. 3A, B, C are cross sectional views of the invention illustrating the process of disengagement.
Figure 3B:
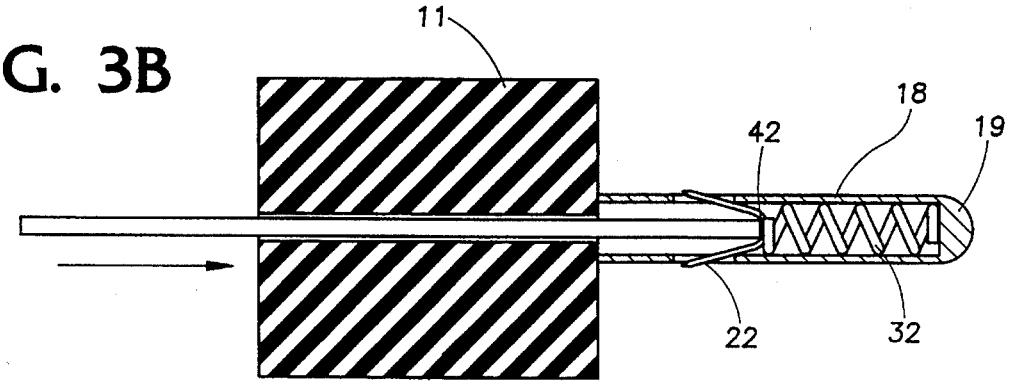
Figure 3C:
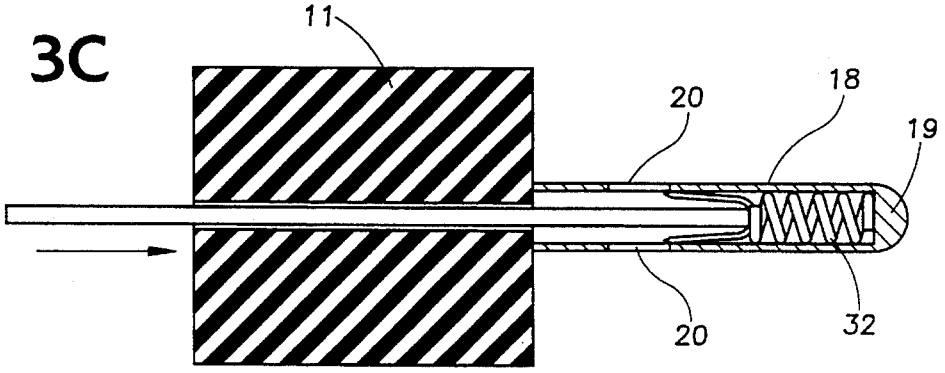

In FIGS. 3A, B and C are shown the process of releasing the catch preparatory to removing the plug from the receptacle. With arms 22 of the catch extended and held in position by the bias force of spring 32 a nonconducting tool 38 is inserted into aperture 40 and engages the arcuate section 42 of the catch. Pressure is applied to the catch by the tool in the direction of the arrow. As the pressure is increased the trailing edge of slot folds the arms in and the catch is eventually contained entirely within the body of the prong. After the plug is removed from the electrical receptacle, the pressure is removed from the catch and it moves backward and the arms expand through the slots and it stands in its normal condition.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. An electrical plug having a body of insulated material, a pair of contact blades connected to electrical wire conductors and adapted to be received in an electrical receptacle and a grounding means for insertion into a grounding hole of the electrical receptacle, the improvement comprising: a hollow cylindrically shaped grounding blade, sealed at one end and open at the other end, and having a pair of opposed slot like apertures positioned midway between the ends thereof; a V-shaped catch in the hollow grounding blade having arms that are self biased to extend through said slots beyond a wall of the hollow grounding blade, and a spring means positioned in the hollow grounding blade between the catch and the sealed end, said spring means biasing the catch toward the plug body and causing the arms to rest against edges limit of said slots and also to rest against a wall of said grounding hole when said plug is inserted in said receptacle.

2. An electrical plug according to claim 1 including: a throughgoing aperture in the body of the plug in alignment with the central axis of the grounding blade, whereby a tool inserted into the aperture will depress the arms of the catch and cause them to retract into the grounding blade.

3. An electrical plug according to claim 1 wherein: an arcuate portion of the V-shaped catch engages the said spring.

4. An electrical plug according to claim 3 wherein: the ends of the catch arms form a point.

* * * * *